US006234851B1

(12) United States Patent
Phillips

(10) Patent No.: US 6,234,851 B1
(45) Date of Patent: May 22, 2001

(54) STAB CONNECTOR ASSEMBLY

(75) Inventor: Quentin Phillips, Mebane, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/437,761

(22) Filed: Nov. 9, 1999

(51) Int. Cl.[7] ..... H01R 13/05
(52) U.S. Cl. ..... 439/825; 439/819; 439/839
(58) Field of Search ..... 439/825, 819, 439/839, 249

(56) References Cited

U.S. PATENT DOCUMENTS

| | | | | |
|---|---|---|---|---|
| 2,051,925 | | 8/1936 | Wertzheiser . | |
| 2,086,641 | | 7/1937 | Riley . | |
| 2,679,579 | | 5/1954 | Knobel . | |
| 2,704,837 | * | 3/1955 | Wintriss | 439/825 |
| 2,945,205 | | 7/1960 | Dierstein . | |
| 3,086,191 | | 4/1963 | Olashaw . | |
| 3,124,403 | | 3/1964 | Rowe . | |
| 3,289,142 | | 11/1966 | Wasileski . | |
| 3,431,544 | * | 3/1969 | Valle et al. | 439/825 |
| 3,777,300 | | 12/1973 | De Villemeur . | |
| 3,778,748 | * | 12/1973 | Holman | 439/701 |
| 3,847,153 | * | 11/1974 | Weissman | 439/825 |
| 4,157,582 | * | 6/1979 | Myers | 439/213 |
| 4,781,627 | | 11/1988 | Farag et al. | 439/687 |
| 5,061,833 | | 10/1991 | Hodder et al. | 200/255 |
| 5,147,992 | | 9/1992 | Eriksen et al. | 439/188 |
| 5,645,437 | | 7/1997 | Meir | 439/110 |

* cited by examiner

*Primary Examiner*—Paula Bradley
*Assistant Examiner*—Tho D. Ta
(74) *Attorney, Agent, or Firm*—Cantor Colburn LLP; Carl B. Horton

(57) ABSTRACT

A stab connector assembly (10) comprising a stab housing (14) having a pair of spaced apart channels (16,18) connected by a passage (20) and a one-piece stab connector (12) disposed within the stab housing (14) is presented. The stab connector (12) has portions extending from the passage. A proximate end of each of the portions have a lug depending therefrom. The lugs are disposed in the channels and are for connection to wire conductors of electrical switching devices.

16 Claims, 4 Drawing Sheets

STAB CONNECTOR ASSEMBLY

BACKGROUND OF THE INVENTION

This invention relates generally to electrical distribution equipment, and, more specifically, to a stab connector assembly having an improved one-piece stab.

The use of switchgears in electrical distribution systems is well known. The switchgear houses a plurality of switching devices, such as motor controllers and circuit breakers, that are releasably interconnected to one or more busbars. Periodically, the switching devices removed from the switchgear to allow for maintenance of the equipment. The switching devices make electrical contact with the busbars through a plurality of stab connectors.

The stab connectors are generally mounted within a stab housing that is affixed to a rear frame inside the switching device. Each stab includes a stab end that protrudes from the stab housing and is aligned for electrical connection with a specific busbar. The stab end frictionally engages the busbar as the switching device is inserted into the switchgear. The end of the stab could be a female end, which fits over a generally cylindrical or rectangular busbar. Alternatively, the stab includes a male end that is inserted into an opening in the busbar and is retained within the busbar. Both the male end and the female end are typically held in position by frictionally engaging the busbar. The stab connector is electrically connected to electrical conductor for connection to the switching devices of the switchgear.

One such prior art stab connector is formed of a pair of strips of identical configuration which are riveted together in face to face relation and have end portions bent back and spaced from intermediate body portions. A pair of leaf springs are secured, also by the rivet, to the body portions of the strips and include bowed portions in the spaces between the terminal portions and the associated body portions, and engaging the inner faces of the bent back end portions. The other ends of the two strips extend laterally from the body portions away from each other to provide electric terminals to which conductors are to be attached.

Such stab connectors have several disadvantages. Primarily, the many pieces used to assemble the stab connector result in an expensive and time extensive assembly process. Also, with many parts the risk of a defect is greater resulting in reliability concerns.

BRIEF SUMMARY OF THE INVENTION

In an exemplary embodiment of the invention, a stab connector assembly comprises a stab housing having a pair of spaced apart channels connected by a passage and a one-piece stab connector disposed within the stab housing. The stab connector has portions extending from the passage. A proximate end of each of the portions have a lug depending therefrom. The lugs are disposed in the channels and are for connection to wire conductors of electrical switching devices.

DETAILED DESCRIPTION OF THE INVENTION

Figure 1:
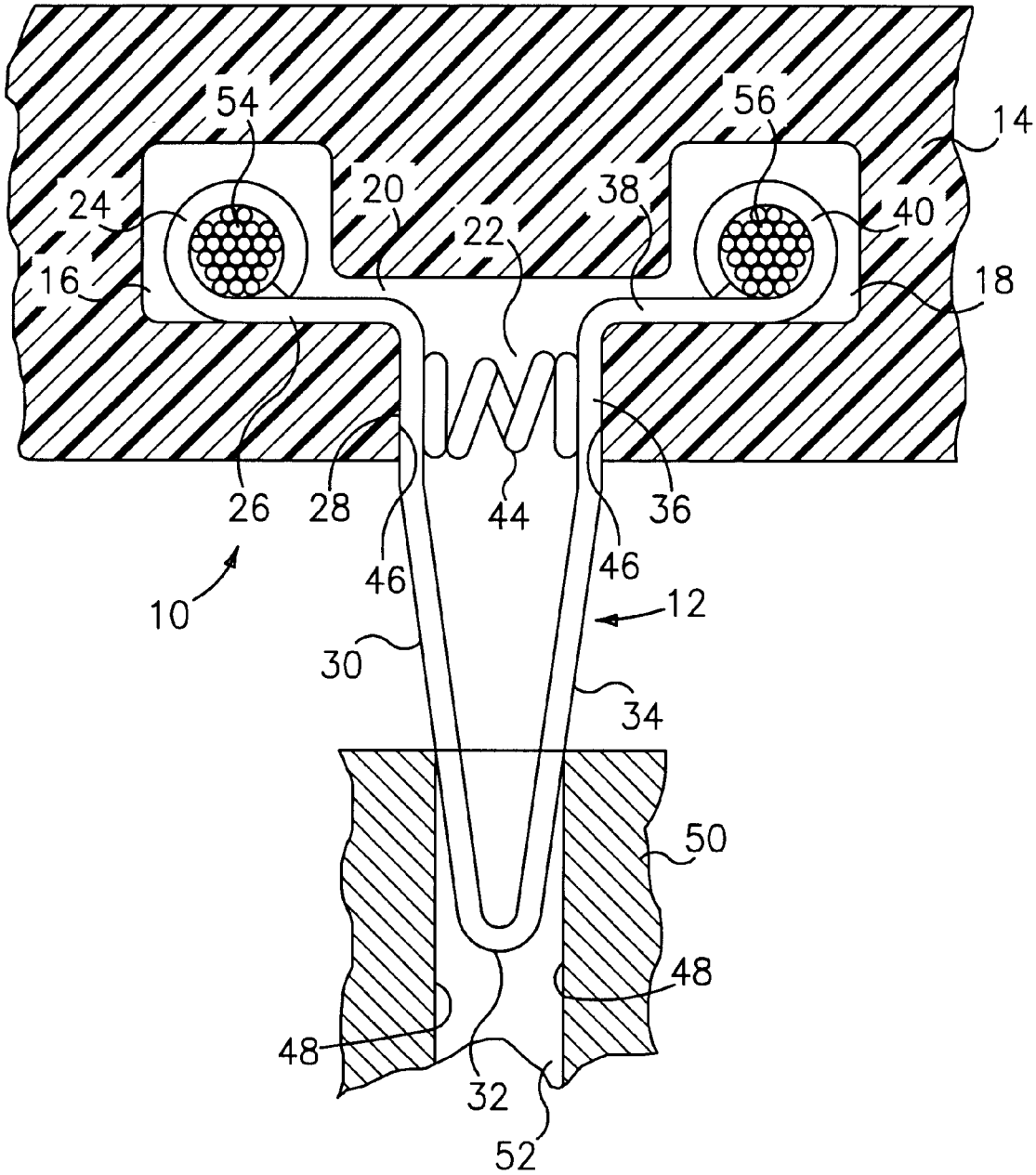
FIG. 1 is a cross sectional view of a stab connector assembly of the present invention, wherein the stab connector assembly is shown as it is being inserted into an opening in a busbar.
Figure 2:
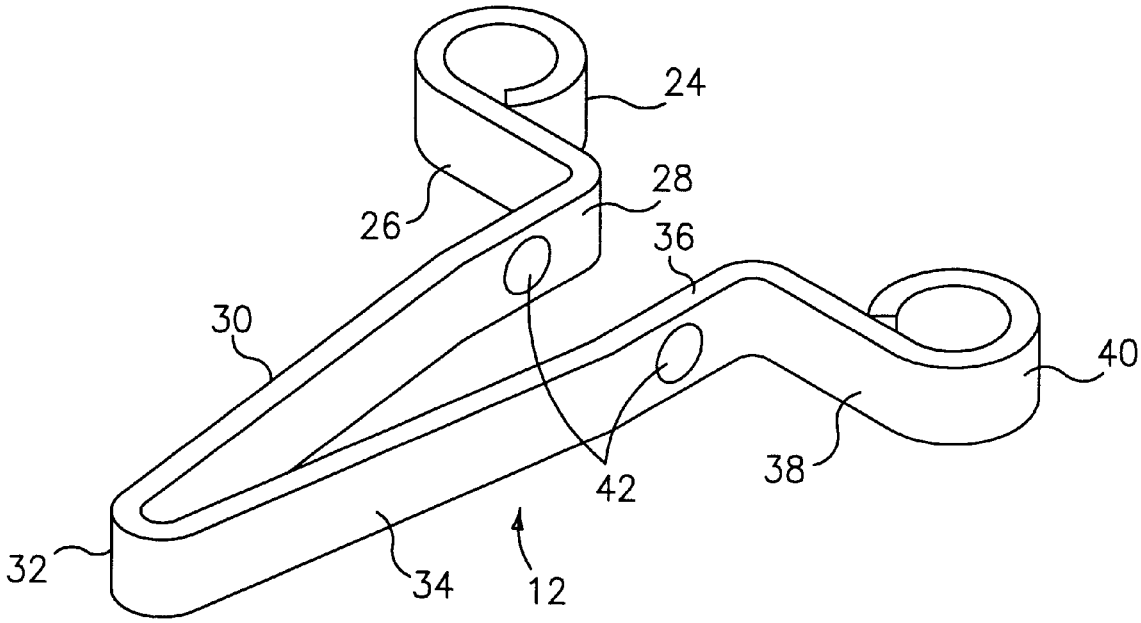
FIG. 2 is a perspective view of a stab of the stab shown in FIG. 1.

Referring to FIGS. 1 and 2, a male stab connector assembly in accordance with an exemplary embodiment of the present invention is generally shown at 10. Stab connector assembly 10 includes a one-piece (unitary) male stab connector 12 supported in a stab housing 14. The stab connector 12 being formed from a single piece is an important feature of the present invention, as it results in substantial assembly time and cost savings. The stab housing 14 is comprised of an insulative material, e.g., plastic, and may comprise multiple sections. Channels 16, 18 extend longitudinally through stab housing 14. These channels 16 and 18 are shown as generally square, although any shape is contemplated by the present invention. Channels 16 and 18 are connected by a first passage 20, with a second passage 22 extending downwardly from about the center of passage 20. Channels 16, 18 and passages 20, 22 together form roughly a T-shaped opening.

The stab connector 12 comprises a first lug 24 which is preferably formed by bending flat metal stock around onto itself at one end thereof. A first extension 26 depends from the first lug 24 followed by downwardly turned (at about a right angle) portion 28, such being formed by bending the metal stock accordingly. A portion 30 depends from portion 28 and is angled slightly relative thereto, again by bending the metal stock. Portion 30 leads to curve (or arcuate) vertex portion 32, from which a portion 34 depends upwardly (forming a V-shape), again by bending the metal stock. Portion 34 leads to a portion 36, which is generally parallel with portion 28, with portion 34 being angled slightly relative to portion 36, by bending the metal stock accordingly. A second extension 38 depends at about a right angle from portion 36, with a second lug 40 formed at the distal end thereof, such being formed by appropriately bending the metal stock.

Stab connector 12 is supported in stab housing 14 with the first lug 24 disposed in channel 16, the second lug 40 disposed in channel 18, the first and second extension 26, 38 disposed in the first passage 20, and the parallel portions 28, 36 disposed in the second passage 22.

Figure 3:
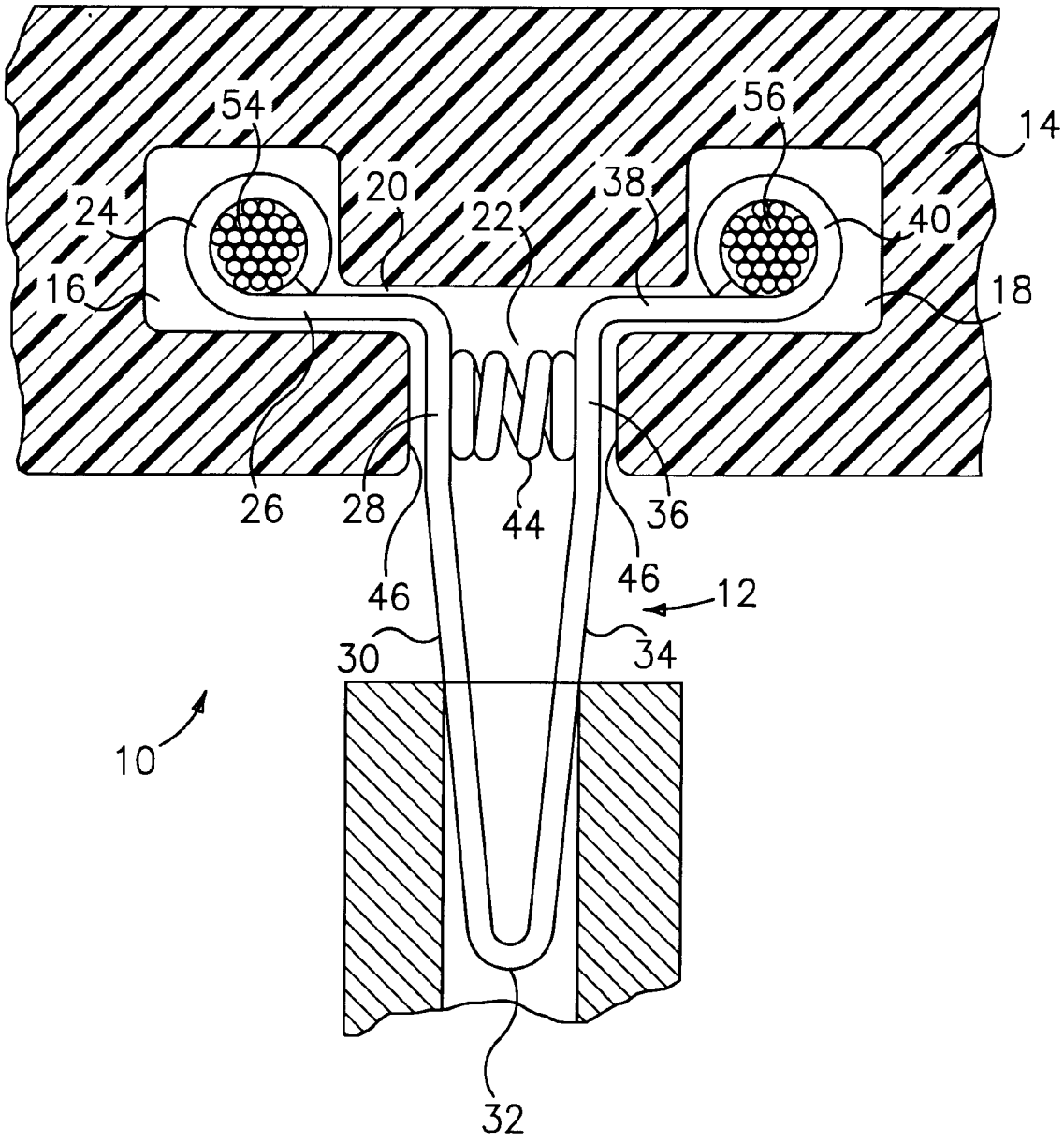
FIG. 3 is a cross sectional view of the stab connector assembly of FIG. 1, wherein the stab connector is fully inserted into the opening in the busbar.

A protrusion 42 extends inwardly from each of the parallel portion 28, 36 for retaining a spring 44 located therebetween. Spring 44 biases parallel portions 28 and 36 apart and thereby against surfaces 46 in the second passage 22. It will be appreciated that channels 16 and 18 are sufficiently sized to allow lugs 24 and 40 to move inwardly when spring 44 is compressed. More specifically, angled portions 30 and 34 engage surface 48 of a busbar 50 at the interior of an opening (hole) 52 in busbar 50, when stab connector 12 is inserted therein (FIG. 1). With continued insertion of stab connector 12 (FIG. 3) portions 30 and 34 are urged closer together and spring 44 compresses. The force exerted by the spring 44 assures good electrical contact between the stab connector and the busbar. While spring 44 is shown as a coil spring, other types of springs may be employed, e.g., a leaf spring, a torsional spring and a helical spring. A further advantage of the present invention is that the spring maintains good electrical contact while allowing the stab connector to free-float in the stab housing. The free-floating characteristic is desirable to accommodate for thermal expansion and other forces acting on the assembly. Also, it is within the scope of the present invention that the metal stock used to form the stab connector 12 be selected from a suitable alloy (such being readily apparent to one of ordinary skill in the art) that will provide sufficient spring action (forces) such that the spring 44 would not be required.

A first conductor (a multi stand wire) 54 is connected to (terminated at) lug 24 and is retained therein by crimping the lug, as is well known (a crimp is formed by imparting a force on the lug with the conductor inserted therein, until the lug is deformed at portions thereof to grip the conductor). A second conductor (a multi stand wire) 56 is connected to (terminated at) lug 40 and is retained therein by crimping the lug, again as is well known. The other ends of these conductors are connected to electrical switching devices, e.g., motor controllers and circuit breakers, as is well known.

Figure 4:
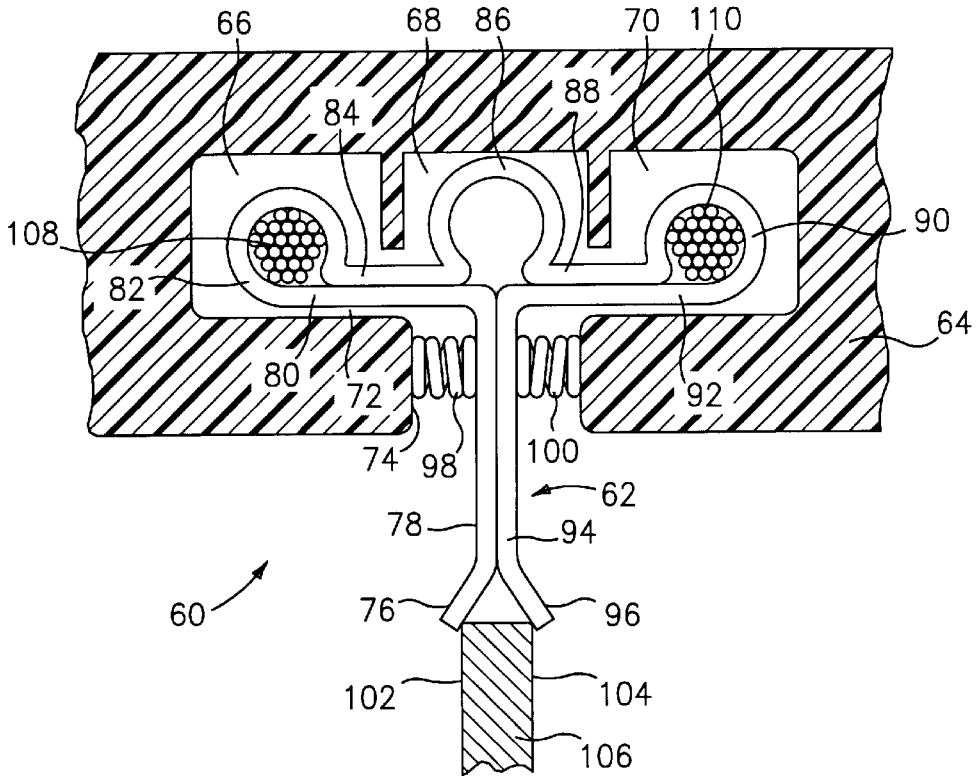
FIG. 4 is a cross-sectional view of a stab connector assembly of an alternate embodiment of the present invention, wherein the stab connector assembly is shown as it is being inserted into an opening in a busbar.

Referring to FIG. 4, a female stab connector assembly in accordance with another exemplary embodiment of the present invention is generally shown at 60. Stab connector assembly 60 includes a one-piece (unitary) stab connector 62 supported in a stab housing 64. The stab connector 62 being formed from a single piece is an important feature of the present invention, as it results in substantial assembly time and cost savings. The stab housing 64 is comprised of an insulative material, e.g. plastic, and may comprise multiple sections. Channels 66, 68, 70 extend longitudinally through stab housing 64. These channels 66, 68 and 70 are shown as generally square, although any shape is contemplated by the present invention. Channels 66, 68 and 70 are connected by a first passage 72, with a second passage 74 extending downwardly from about the center of passage 72.

The stab connector 62 comprises a first end portion 76 which leads to a portion 78, with end 76 being angled away from portion 78. The stab connection 62 is preferable formed by bending flat metal stock to form the stab connector described herein. Portion 78 then leads to a turned (at about a right angle) portion (or extension) 80 with a first lug 82 formed at the distal end thereof. A portion 84 continues from lug 82 leading to semi-looped portion 86 which leads to a portion 88. A second lug 90 is formed at the end of portion 88 and leads to an extension 92. Extension 92 then leads to a turned (at about a right angle) portion 94, which leads to a second end portion 96. Portions 78 and 94 are adjacent (parallel) each other with end portions 76 and 96 being spaced apart.

Stab connector 62 is supported in stab housing 64 with the first lug 82 disposed in channel 66, the semi-looped portion 86 disposed in channel 68, the second lug 90 disposed in channel 70, portions 80, 84, 88 and 92 disposed in the first passage 72, and parallel portions 78 and 94 extending through the second passage 74.

Figure 5:
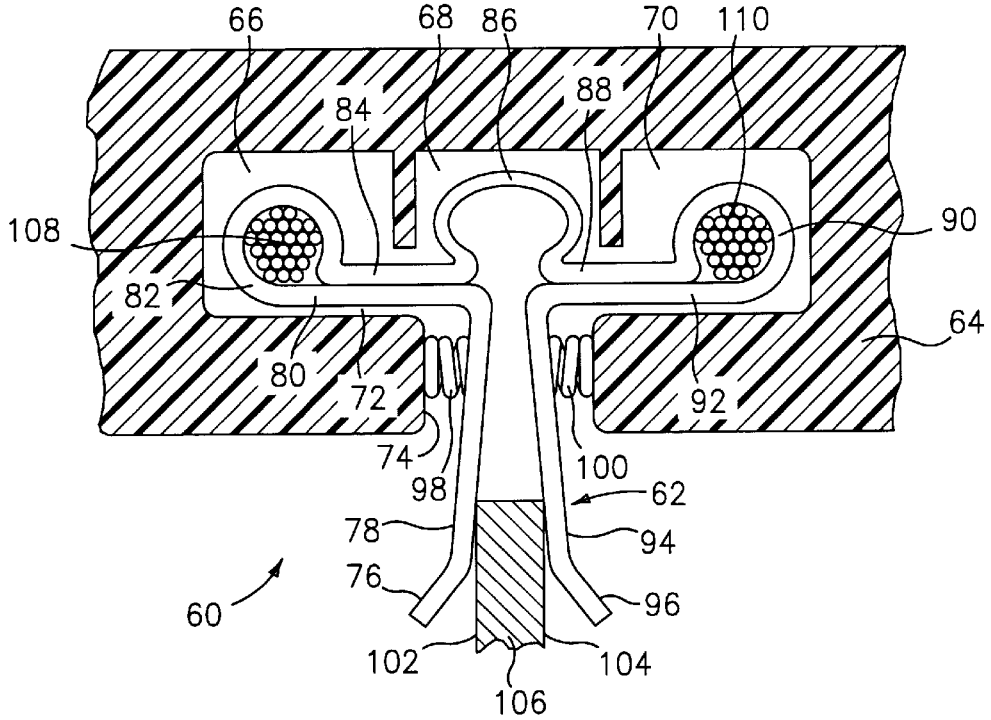
FIG. 5 is a cross sectional view of the stab connector assembly of FIG. 4 wherein the stab connector is fully inserted into the opening in the busbar.

Protrusions (not shown) extend outwardly from each parallel portion 78 and 94, and inwardly from housing 64 within passage 74 for retaining springs 98 and 100 therebetween. It will be appreciated that channels 66 and 70 are sufficiently sized to allow lugs 82 and 90 to move outwardly when springs 98 and 100 are compressed. More specifically, end portions 76 and 96 engage surfaces 102 and 104, respectively, at a busbar 106, when stab connector 62 is inserted on busbar 106 (FIG. 4), with continued insertion at stab connector 64 (FIG. 5) portions 76 and 96 are urged apart and springs 98 and 100 compress. The force exerted by the springs 98 and 100 assures good electrical contact between the stab connector and the busbar. While springs 98 and 100 are shown as coil springs, other types of springs may be employed, e.g. leaf springs, torsional springs and helical springs. Also, it is within the scope of the present invention that the metal stock used to form the stab connector 62 be selected from a suitable alloy (such being readily apparent to one of ordinary skill in the art) that will provide sufficient spring action (forces), due primarily to semi-loop portion 86, such that springs 98 and 100 would not be required.

A first conductor (a multi stand wire) 108 is connected to (terminated at) lug 82 and is retained therein by crimping the lug, as is well known (a crimp is formed by imparting a force on the lug with the conductor inserted therein, until the lug is deformed at portions thereof to grip the conductor). A second conductor (a multi stand wire) 110 is connected to (terminated at) lug 90 and is retained therein by crimping the lug, again as is well known. The other ends of these conductors are connected to electrical switching devices, e.g., motor controllers and circuit breakers, as is well known.

While preferred embodiments have been shown and described, various modifications and substitutions may be made thereto without departing from the spirit and scope of the present invention. Accordingly, it is to be understood that the present invention has been described by way of illustration and not limitation.

What is claimed is:

1. A stab connector assembly comprising:

a stab housing having a pair of spaced apart channels connected by a passage; and a one-piece stab connector disposed within said stab housing, said stab connector having portions extending from said passage, a proximate end of each of said portions having a lug depending therefrom, to terminate an electrical conductor said lugs being disposed in said channels.

2. The stab connector assembly of claim 1 further comprising:

a spring disposed in-between said portions near said proximate end thereof.

3. The stab connector assembly of claim 1 wherein said stab connector is a male stab connector.

4. The stab connector assembly of claim 1 wherein said stab connector is a female stab connector.

5. The stab connector assembly at claim 1 wherein said portions are connected together at a distal end thereof and spaced apart at a proximate end thereof.

6. The stab connector assembly of claim 5 wherein said portions includes an arcuate portion, said distal end of said portions are connected together by said arcuate portion.

7. The stab connector assembly of claim 5 wherein said portions include:

an extension portion depending from each of said lugs;

a first portion depending at about a right angle from an end of each of said extension portions, said first portions being spaced apart and generally parallel to each other; and a second portion depending at one end thereof from said first portion and depending at an angle relative to said first portion, said second portions being spaced apart at said one end and connected together at the other end.

8. The stab connector assembly of claim 7 wherein said passage comprises a first passage connecting said channels and a second passage depending from about a center of said first passage.

9. The stab connector assembly of claim 8 wherein said extension portions are disposed in said first passage and said first portions are disposed in said second passage.

10. The stab connector assembly of claim 7 further comprising:

a spring disposed in-between said second portions near said end having said second portions spaced apart.

11. The stab connector assembly of claim 10 further comprising protrusions depending from said first portions, said spring disposed at said protrusions for retaining said spring.

12. The stab connector assembly of claim 1 wherein said portions are spaced apart at a distal end thereof and adjacent at said proximate end thereof.

13. The stab connector assembly of claim 12 wherein:

said stab housing further includes another channel disposed between spaced apart channels; and said stab connector further includes a semi-loop portion depending between said lugs, said semi-loop portion being disposed in said other channel.

14. The stab connector assembly of claim 12 wherein said passage comprises a first passage connecting said channels and a second passage depending from about a center of said first passage.

15. The stab connector assembly of claim 14 further comprising:

a spring disposed in-between each of said portions and said stab housing within said second passage.

16. The stab connector assembly of claim 15 further comprising protrusions depending from said portions and said stab housing, said springs disposed at said protrusions for retaining said springs.

* * * * *